United States Patent [19]

Hashish et al.

[11] Patent Number: 4,955,164

[45] Date of Patent: Sep. 11, 1990

[54] METHOD AND APPARATUS FOR DRILLING SMALL DIAMETER HOLES IN FRAGILE MATERIAL WITH HIGH VELOCITY LIQUID JET

[75] Inventors: Mohamed Hashish, Kent; Steve Craigen, Auburn, both of Wash.

[73] Assignee: Flow Research, Inc, Kent, Wash.

[21] Appl. No.: 367,422

[22] Filed: Jun. 15, 1989

[51] Int. Cl.[5] ..... B24B 1/00; B24C 9/00

[52] U.S. Cl. ..... 51/321; 51/424; 51/436

[58] Field of Search ..... 51/424, 436, 410, 415, 51/321, 411; 261/41.5; 239/9, 72

[56] References Cited

U.S. PATENT DOCUMENTS

| | | | |
|---|---|---|---|
| 3,524,367 | 8/1970 | Franz | 51/321 |
| 3,691,695 | 9/1972 | Green et al. | 51/415 |
| 3,769,753 | 11/1973 | Fleischer | 51/424 |
| 3,903,526 | 9/1975 | Cotter | 51/410 |
| 4,146,049 | 3/1979 | Kruse et al. | 239/72 |
| 4,272,017 | 6/1981 | Franz | 83/53 |
| 4,562,960 | 1/1986 | Marty et al. | 239/72 |
| 4,614,100 | 9/1986 | Green et al. | 51/415 |
| 4,702,042 | 10/1987 | Herrington et al. | 51/321 |
| 4,707,952 | 11/1987 | Krasnoff | 51/436 |
| 4,712,736 | 12/1987 | Bray et al. | 239/72 |
| 4,846,402 | 7/1989 | Sandell et al. | 239/9 |

*Primary Examiner*—J. J. Hartmann
*Assistant Examiner*—Mark Frazler
*Attorney, Agent, or Firm*—Ashen Golant Martin & Seldon

[57] ABSTRACT

An abrasivejet drilling system is disclosed for drilling small diameter holes in fragile materials of the type which tend to crack when impacted by such jets. The system employs a drilling jet formed from a high pressure liquid whose pressurization varies with time during the drilling process. To avoid damage to fragile materials, angular holes are drilled by initially penetrating the surface of the fragile workpiece perpendicular to the workpiece's surface and thereafter pivoting the jet to the correct angle. The jet dwell in the drilled hole for a predetermined time to modify the hole geometry is monitored by detecting the change in sound level when the jet drills completely through the workpiece.

23 Claims, 5 Drawing Sheets

FIG. 1
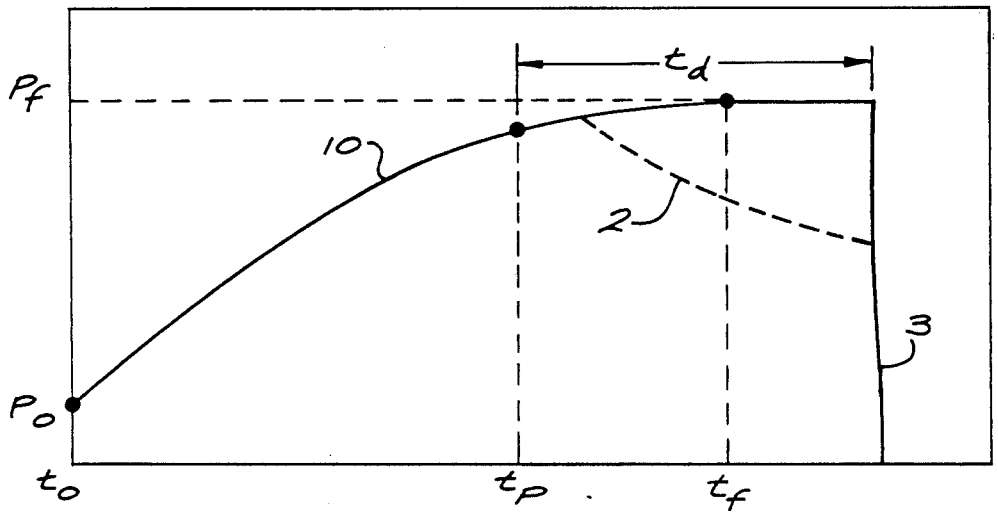
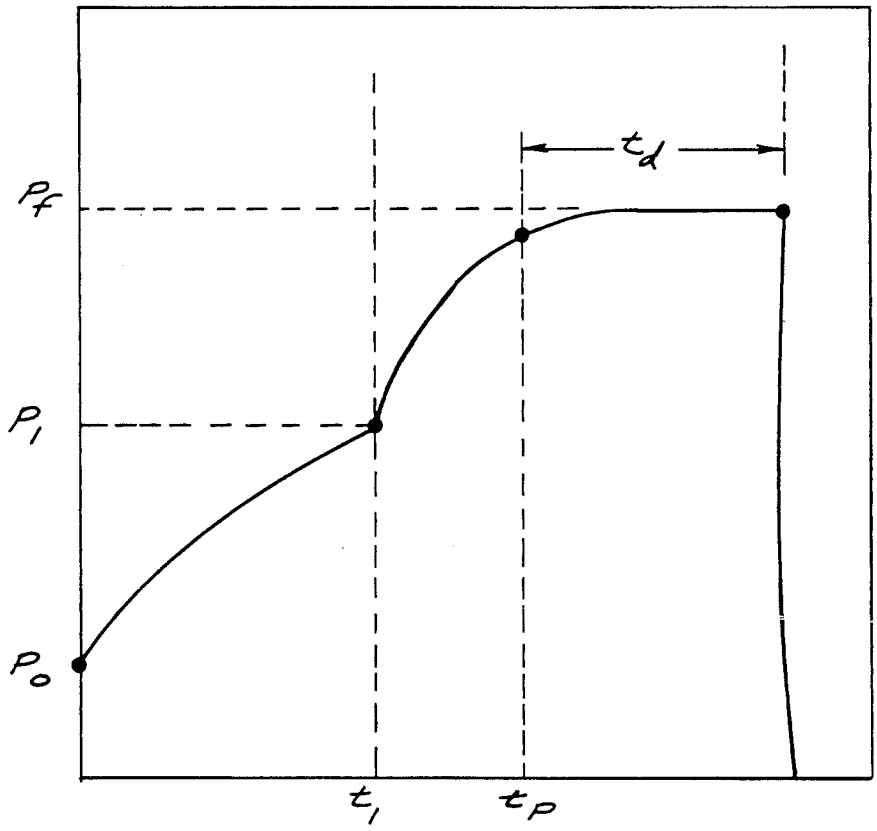
FIG. 2

METHOD AND APPARATUS FOR DRILLING SMALL DIAMETER HOLES IN FRAGILE MATERIAL WITH HIGH VELOCITY LIQUID JET

This invention relates to cutting systems of the type utilizing a high velocity, liquid jet.

BACKGROUND OF THE INVENTION

The use of high velocity, abrasive-laden liquid jets to precisely cut a variety of materials is well known. Briefly, a high velocity waterjet is first formed by compressing the liquid to an operating pressure of 35,000 to 70,000 psi, and forcing the compressed liquid through an orifice having a diameter approximating that of a human hair; namely, 0.001–0.015 inches. The resulting highly coherent jet is discharged from the orifice at a velocity which approaches or exceeds the speed of sound.

The liquid most frequently used to from the jet is water, and the high velocity jet described hereinafter may accordingly be identified as a waterjet. Those skilled in the art will recognize, however, that numerous other liquids can be used without departing from the scope of the invention, and the recitation of the jet as comprising water should not be interpreted as a limitation.

To enhance the cutting power of the liquid jet, abrasive materials have been added to the jet stream to produce an abrasive-laden waterjet, typically called an "abrasive jet". The abrasive jet is used to effectively cut a wide variety of materials from exceptionally hard materials such as tool steel, aluminum, cast iron armor plate, certain ceramics and bullet-proof glass, to soft materials such as lead. Typical abrasive materials include garnet, silica, and aluminum oxide having grit sizes of #36 through #200.

To produce the abrasive-laden waterjet, the high velocity jet passes through a mixing region in the nozzle housing wherein a quantity of abrasive is entrained into the jet by the low pressure region which surrounds the flowing liquid in accordance with the Bernoulli Principle. The abrasive is typically drawn via a conduit into the mixing region from an external hopper by the Bernoulli-induced suction.

The abrasive-laden waterjet is then discharged against a workpiece that is supported closely adjacent to the discharge end of the nozzle housing. Additional information and details concerning abrasivejet technology may be found in U.S. Pat. No. 4,648,215, the contents of which are hereby incorporated by reference.

New applications in the electronics and aerospace industries require the drilling of small holes in pressure-sensitive materials, composites and laminates of the type which tend to chip, crack, fracture, or delaminate when impinged upon by the abrasive jet. Although abrasive jets have been used to cut a wide variety of materials, no commercially satisfactory apparatus has been available for drilling small diameter holes (i.e., as small as 0.010 inches) in such fragile materials, composites and laminates. Many aerospace components, for example, consist of ceramic material, or of a metal substrate coated with a ceramic material for thermal protection. The ceramic material tends to chip when the component is impacted by a small diameter abrasive jet in order to drill a hole in the workpiece.

DESCRIPTION OF THE PRIOR ART

Although not directed to laminates and/or composite materials, U.S. Pat. Nos. 4,702,042 and 4,703,591 disclose an abrasivejet system for cutting strengthened glass, wherein the jet is described as penetrating a strengthened glass sheet at a reduced fluid pressure of 10,000 psi. After the jet has penetrated through the sheet, the fluid pressure is raised to 30,000 psi and the cutting process is commenced. The jet-forming fluid is described as being pressurized by a high pressure pump which is variably controlled between 10,000 to 30,000 psi.

SUMMARY OF THE INVENTION

A method and system is disclosed herein for drilling small diameter holes with a liquid jet or abrasivejet in workpieces having at least one layer of pressure-sensitive, composite and/or laminate material. Briefly, the method comprises the step of drilling through the workpieces with a jet formed by a liquid subjected to time-varying pressure profile. Quantitatively, the optimum relationship between time and pressure varies from material to material, depending on the type and thickness of the material. However, the qualitative time-pressure relationship is similar for a majority of applications.

More specifically, the method herein comprises the steps of coupling a source of high pressure liquid to the jet-forming orifice of a nozzle assembly via time-dependent pressure-varying means to form a coherent, high velocity jet from the variably pressurized liquid. The jet is directed at the workpiece, and the pressure is vamped during at least a substantial portion of the drilling operation.

As will be discussed, the method and system herein contemplates that the direction of ramping and rate of ramping can be tailored to characteristics of the workpiece. For example, a laminate workpiece comprising a hard metal substrate with a fragile ceramic coating can be drilled by commencing the operation at a first lower pressure which increases at a first rate until the substrate is reached, and then increases at a faster rate until full drilling pressure is reached. If the drilling is to start on the metal side, however, the operation commences at full drilling pressure, rapidly decreased slightly prior to reaching the metal/ceramic interface, and ramped downward as the jet drills through the ceramic so that the jet emerges from the ceramic at a minimum drilling pressure which yields a high quality hole with an absence of cracks or burring as it penetrates the workpiece.

To provide for a time-variable drilling pressure which can be tailored to the workpiece, a system is disclosed comprising a source of high pressure liquid, means for producing a time-varying reduction in the high pressure fluid emerging from the source, and a nozzle assembly having a jet-forming orifice in fluid communication with the source of high pressure fluid via the reduction producing means for forming a high velocity liquid jet.

The reduction-producing means preferably includes means for selectively permitting the pressure upstream of the jet-forming orifice to ramp between a minimum non-zero value and full drilling pressure.

Additional details concerning the invention will be apparent from the following Description the Preferred Embodiment of which the drawing is a part.

BRIEF DESCRIPTION OF THE DRAWING

FIGS. 1–3 are graphic representations of various time-pressure profiles employed in the drilling of various types of workpieces by of a waterjet or abrasivejet;

DESCRIPTION OF THE PREFERRED EMBODIMENT

The method and system described herein employ a water jet or abrasivejet driven by a pressure which varies with time during the drilling process, and is particularly suitable for drilling small diameter holes in fragile material of the type which tends to crack when impacted by such jets. Reference is initially made to FIG. 1 which is a graphic illustration of a pressure-time profile utilized herein. The graphic profile comprises a curve 1 which starts at an initial value $P_o$ at the time $t_o$ that the jet is activated against the pressure-sensitive material. The initial value of pressure may or may not be atmospheric. The pressure is gradually increased during the drilling operation to a final pressure of $P_f$ at time $t_f$. The jet drills completely through the material at time $t_p$, which can be greater or less than time $t_f$ but is illustrated as being less by way of example.

After penetrating through the material, the jet may be permitted to dwell in the drilled hole for a time $t_d$. The amount of dwell time determines the final size and shape of the hole; as $t_d$ increases, the diameter of the hole will increase. During the time $t_d$, the pressure may continually vary or may reach the steady value $P_f$. If the penetration time $t_p$ is less than the time at which final steady pressure is reached, $t_f$, it may be desirable to decrease the pressure before it reaches the final value $P_f$, as illustrated by the dotted line 2 in FIG. 1.

It will be appreciated that the total time during which the jet is activated is accordingly $t_p$ plus $t_d$. After reaching the time "$t_p+t_d$", the jet flow can be stopped by an on/off valve which results in a rapid pressure drop to ambient as illustrated by the substantially vertical portion of the curve at 3.

FIG. 2 is a graphic illustration of a pressure-time profile utilized in accordance with the invention to drill through a workpiece having two layers of different materials. In the illustrated case, the first layer encountered by the jet is a fragile layer, while the second layer is not. An example of one typical workpiece having these characteristics is a metal sprayed with a relatively fragile ceramic layer which can chip when drilled by high pressure jets.

The relationship is similar to that illustrated in FIG. 1, except that the rate of pressure increase is changed at or close to the interface of two materials. Specifically, the pressure increases from $P_o$ to $P_1$ at a first rate until time $t_1$ when the jet is at, or close to, the interface of the two layers of material. The pressure thereafter increases at a second rate during the period between $t_1$ and $t_f$, the time at which steady state pressure is reached. Thus, in the case of the ceramic-sprayed metal, the jet pressure is increased at a higher rate to more efficiently drill through the metal layer after the jet has drilled through the ceramic layer,.

Figure 3:
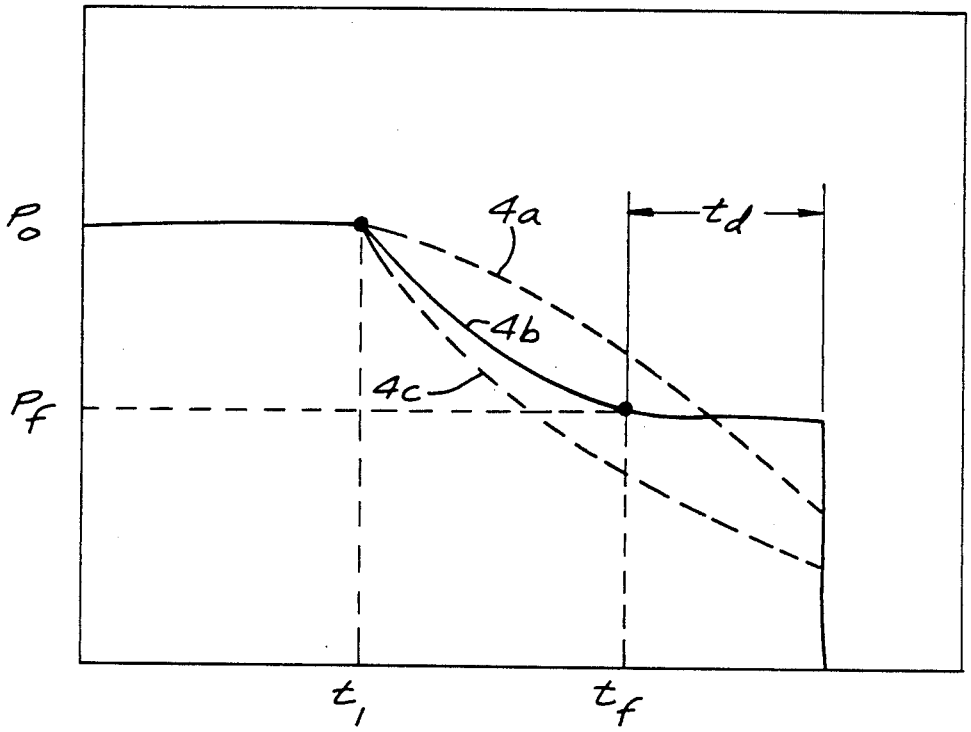

If, on the other hand, one commences the drilling operation on the metal side of a metal/ceramic laminate workpiece, the preferred pressure profile is that graphically illustrated in FIG. 3. The initial pressure $P_o$ is maintained at the maximum working pressure until the jet has reached or is close to the metal/ceramic interface. The pressure is then decreased at a rate which avoids a chipping of the ceramic, and reaches a final pressure which avoids the creation of chips or burrs as the jet emerges from the backside of the workpiece. Three alternative pressure-decaying profiles 4*a*, 4*b*, 4*c* are illustrated in FIG. 3.

It may be noted that the time-varying pressure profiles illustrated in FIGS. 1–3 differ from the unintentionally slight variations in pressure which may sometimes occur as a result of pump stroke, etc., and also differ from the rapid build-up and dissipation of pressure which might accompany the start-up and shut-down of a waterjet cutting cutting system.

Quantitatively, the optimum relationship between time and pressure varies from material to material, depending on the type and thickness of the material. For example, the initial starting pressure $P_o$ for plate glass, lead glass, borosilicate glass, optical glass and other industrial glass is approximately 2000 to 4000 psi. The final pressure $P_f$ is approximately 25,000 psi, and the ramping rate can be up to 2000 psi/sec. A satisfactory time duration between $t_o$ and $t_f$ is 15 seconds for ½-inch thick glass and 15 minutes for 12-inch thick glass.

Ceramic material can be drilled with an initial pressure of 5000 to 6000 psi, a final pressure of 45,000 psi, and a ramp rate of up to 2000 psi/sec. for soft ceramics (e.g., spray-coated ceramics) and 3000 psi/sec. for hard ceramics. By contrast, non-fragile materials such as metals can withstand ramp rates of approximately 20,000 psi/sec. To avoid chipping and burr formation as the jet drills through the back side of workpiece having a back surface formed from fragile material, the final pressure $P_f$ illustrated in FIG. 3 is approximately 5,000 psi.

Optimum time durations, pressures and rates are empirically determined for each specific material of a given thickness as the need arises. Accordingly, a drilling system is preferred in which the various pressures and time durations can be conveniently controlled and adjusted without undue equipment cost or labor cost.

Figure 4:
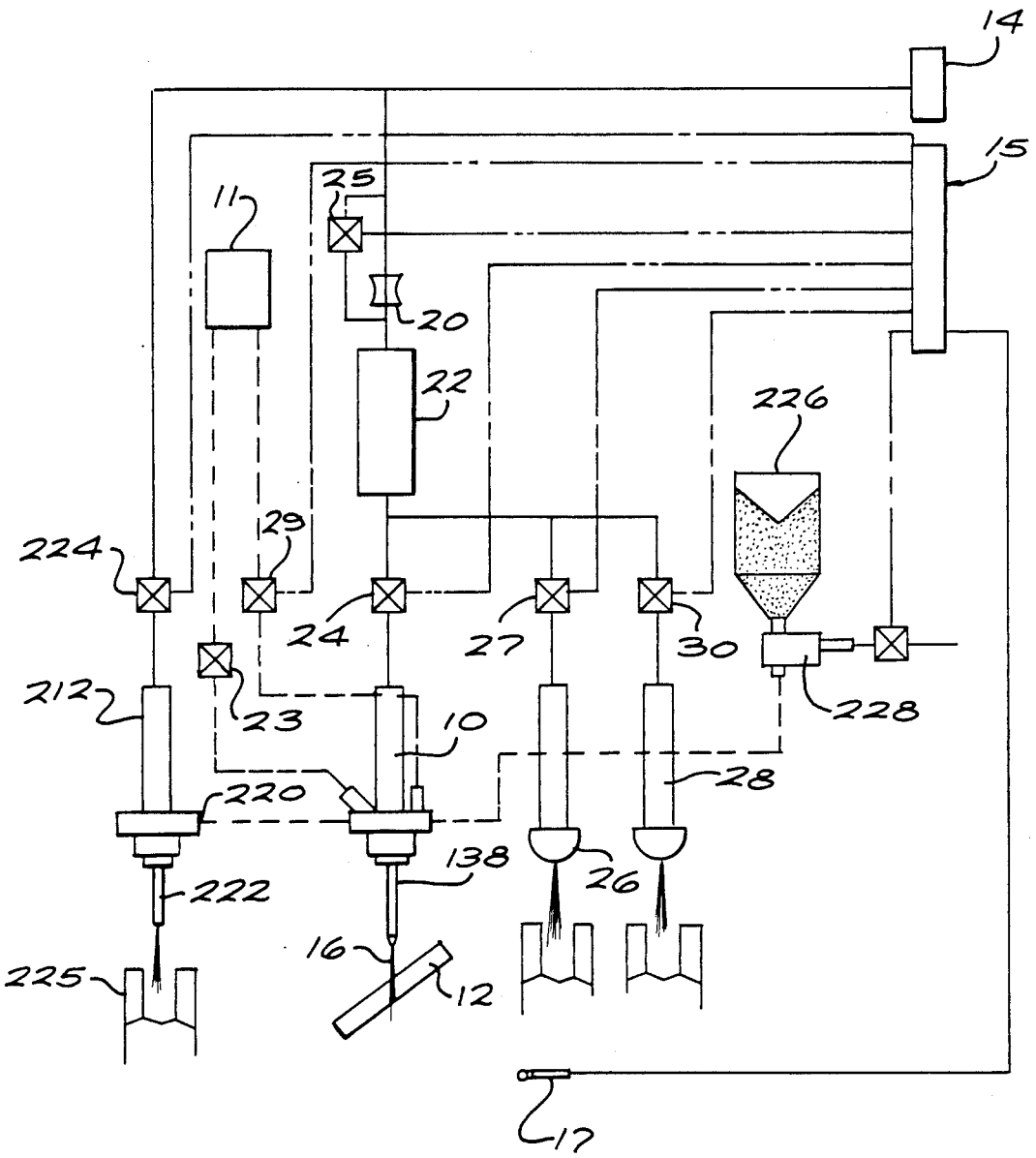
FIG. 4 is a block diagrammatic representation of an abrasivejet system constructed in accordance with the invention.

FIG. 4 is a block diagram representation of an abrasivejet drilling system constructed in accordance with the invention for tailoring the jet pressure to the drilling application at hand. The system comprises a drilling nozzle assembly 10 positioned immediately adjacent a workpiece 12 formed with one or more layers of a pressure-sensitive material. The workpiece may, for example be wholly formed from such material, or may be a laminate of one or more layers of such material with or without one or more layers of interjacent non-fragile material.

The drilling nozzle assembly 10 is configured to receive pressurized liquid, such as water, from a high pressure source 14, and to form an abrasive-laden, highly coherent, high velocity liquid jet 16 which is directed at the assembly's downstream end against the workpiece. Although some general characteristics of a preferred nozzle assembly are described below, additional details may be found in our co-pending U.S. patent application Ser. No. 335,054, filed Apr. 7, 1989, the contents of which are hereby incorporated by reference.

Figure 5:
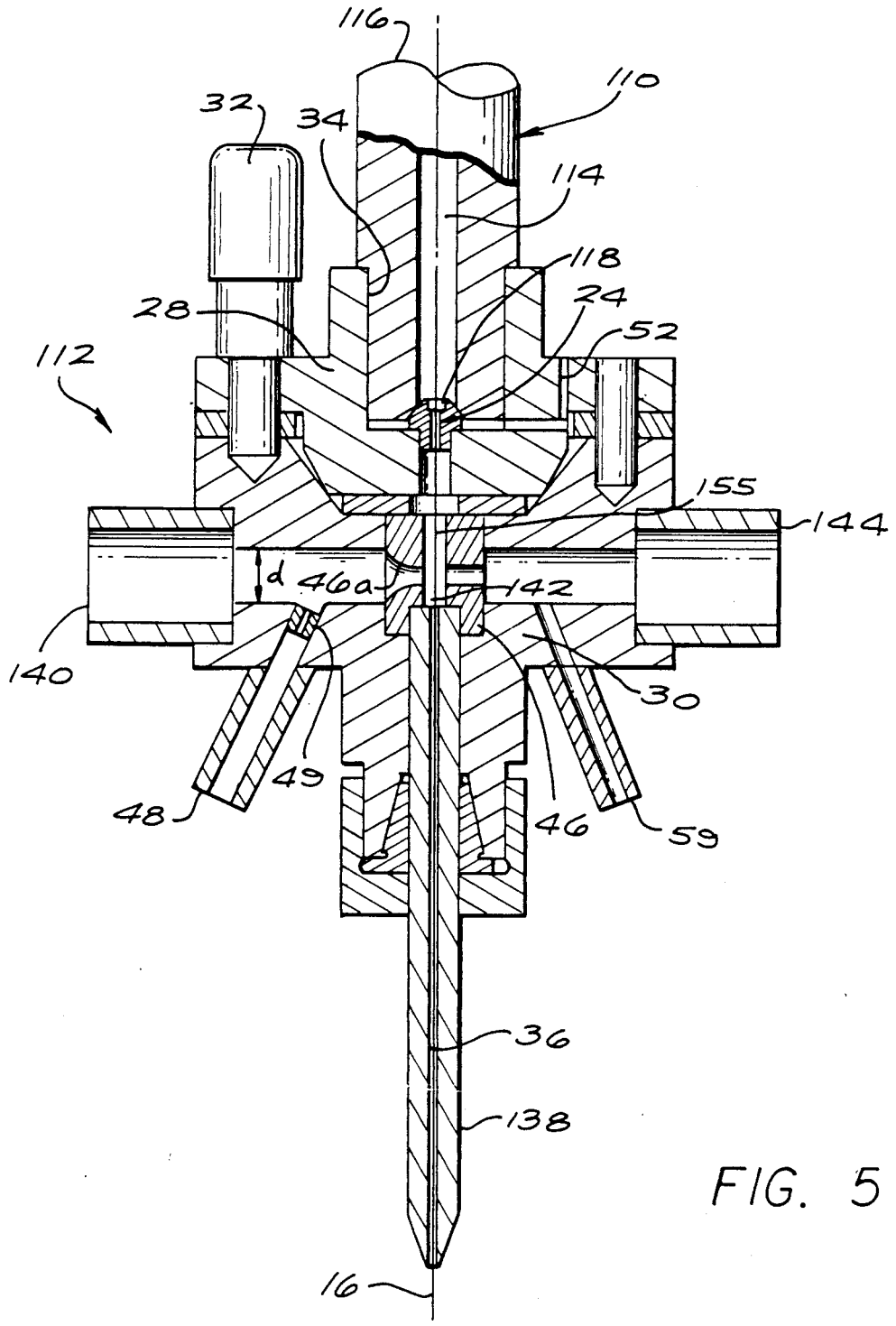
FIG. 5 is a sectional view of a nozzle assembly constructed in accordance with the invention.

Referring to FIG. 5, an abrasivejet nozzle assembly a waterjet orifice housing 110 and an abrasivejet housing 112. The waterjet orifice housing 110 has a liquid-passage 114 extending axially from an upstream end region 116. An inlet port (not shown) in the upstream end region 116 permits the ingress of high pressure water (or other suitable liquid) into the passage 114. The term "high pressure" is used to denote pressures in the range of 35,000 to 55,000 psi. Those skilled in the art will recognize that the sources of such highly pressurized water are typically intensifier pumps which form part of an abrasivejet cutting system. A description of these pumps is beyond the scope of this specification, and is accordingly omitted for the sake of brevity.

A jewel orifice-defining member 118 has a jet-forming orifice positioned in the downstream end region of the passage 114 to produce a highly coherent, high velocity cutting jet from the high pressure water passing through the orifice. The jewel orifice member 118 is preferably formed from an extremely hard material such as synthetic sapphire or diamond.

An axially-extending discharge tube 138 is mounted in the downstream end of the abrasive jet housing 112 and positioned closely adjacent to the workpiece during the drilling operation to discharge the abrasive-laden jet 16 against the workpiece.

The abrasivejet housing 112 further includes an abrasive conducting entry passage 140 for conducting abrasive from an external hopper 226 (or other source) to a mixing region 142 within the housing 112. As is known in the art, the abrasive typically comprises (but is rot limited to) a fine garnet or silica powder, and is drawn into the assembly by the low pressure surrounding the moving jet in accordance with the Bernoulli Principle. The abrasive is conducted to the mixing region downstream from the jet-producing orifice in member 118 and adjacent the high velocity jet so that the abrasive becomes entrained with the jet by the low pressure region which surrounds the moving liquid.

An abrasive outlet passage 144 for conducting abrasive and/or abrasive-laden liquid is also formed in abrasivejet housing 112. The abrasive outlet passage 144 communicates at one end with the mixing region 142, and is preferably diametrically opposite to, and co-axially aligned with, the inlet abrasive passage 140. The outlet passage 144 is coupled to a vacuum device which maintains a generally constant inflow of abrasive from the external hopper 226 through the inlet passageway 140 during periods in which the Bernoulli Effect surrounding the flowing waterjet 155 is insufficient to maintain a level of abrasive flow which yields satisfactory drilling or incapable of transporting abrasives from a remote hopper.

Although some general characteristics of the vacuum-assisted abrasive flow technique will be described below, details are described in greater detail in our co-pending U.S. patent application Ser. No. 308,730 filed Feb. 9, 1989, the contents of which are incorporated by reference.

The vacuum device preferably utilized to maintain a substantially constant flow rate of abrasive through the drilling nozzle assembly 10 is a second nozzle assembly 212 (FIG. 4). The vacuum nozzle assembly 212 accordingly includes an abrasive-conducting inlet communicating via a conduit 220 with the abrasive-conducting outlet 144 (FIG. 5) formed in the nozzle assembly 10. The conduit 220 passes through a valving arrangement 214 which is preferably a solenoid operated air-driven on/off valve operable by a standard 100 psi source commonly found in industrial environments.

The vacuum nozzle assembly 212 has a jet-discharging tube 222 comparable to the discharge tube 138 of the drilling nozzle assembly 10. The discharge tube 222 is positioned with its jet-discharging end in an energy-dissipating device 225, commonly referred to in the art as a catcher. Since the vacuum nozzle assembly 212 is not intended to cut or drill a workpiece, its components are sized to create maximum suction, rather than an efficient jet. Accordingly, the vacuum nozzle assembly 212 is provided, for example, with a jet-forming orifice diameter of 0.010 inches, a discharge tube length of 2 inches and a discharge tube diameter of 0.060 inches.

The drilling nozzle assembly 10 and the vacuum nozzle assembly 212 are coupled at their upstream ends to a pair of on/off valves 24, 224 respectively, which are controlled by means 15 that selectively permits or obstructs the formation of the jets within the nozzle assemblies. Preferably, the valves are air-driven structures operable from the same air supply as the abrasive valve. One example of suitable valve structures may be found in U.S. Pat. No. 4,313,570 which issued on Feb. 2, 1982 to John H. Olsen. The contents of that patent are incorporated by reference.

Naturally, any other source of suitable partial vacuum may be utilized in place of the suction nozzle assembly, although the suction nozzle assembly appears be a low cost device which accomplishes the function with maximum reliability and minimal maintenance. As an alternative to the vacuum assist, however, the feed rate of abrasive varied by valve means in the feed line so that the feed rate of the abrasive generally increases (or decreases) with the time-varying pressure of the drilling jet liquid. When the previously discussed vacuum source establishes the abrasive feed rate, the drilling nozzle assembly simply takes what it can from the stream of abrasive passing through its mixing region en route to the vacuum source. As the pressure of the drilling liquid upstream from the jet-forming orifice increases, the low pressure Bernoulli region surrounding the flowing jet entrains more abrasive into the jet. This increasing entrainment rate can accordingly also be satisfied by a microprocessor controlled valve in the abrasive feed line which adjust the feed rate of abrasive in at least general accordance with the pressure profile associated with the drilling operation.

The system illustrated in FIG. 4 includes a drilling nozzle 10 having a jet-forming orifice diameter ($d_d$) of 0.005 inches, and a discharge tube having a length ($l_m$) of 4.0 inches and inner diameter ($d_m$) of 0.018 inches. The vacuum nozzle assembly 212, by contrast, has a jet-forming orifice 0.010 inches in diameter, and a discharge tube which is 2 inches long and 0.060 inches in inside diameter.

The drilling nozzle assembly 10 is serially coupled in fluid communication with the source of high pressure liquid 14 through a ramping orifice member 20, an accumulator 22 and an on/off valve 24. A bypass valve 25 is coupled in parallel with the ramping orifice 20 to selectively provide a fluid path therearound. As implied by the name, the ramping orifice, whose function is explained below, has a small fluid-conducting orifice through which fluid flows from the high pressure source 14 into the accumulator 22. The diameter ($d_u$) of the orifice is approximately 0.005 inches. The accumulator is simply a high pressure container. In practice, an accumulator with an internal volume of approximately 60 cubic inches has been found satisfactory The ramping orifice 20 may function as the entry orifice if suitable bypass valving arrangements are made.

The combination of the ramping orifice and accumulator create a pressure in the liquid at the jet-forming nozzle which ramps from an initial pressure $P_o$ to a final pressure $P_f$. High pressure liquid enters the accumulator through the ramping orifice at a higher rate than the liquid exiting the accumulator. After filling the accumulator, the liquid becomes compressed within the accumulator as additional high pressure liquid enters faster than the liquid can exit. As the liquid becomes compressed, the pressure downstream of the accumulator increases until it reaches a steady pressure that depends on the orifice sizes $d_u$ and $d_d$. If $d_u = d_d$, the maximum drilling pressure will be approximately one-half the pressure value at the source 14.

The value of $P_o$ is established in the illustrated embodiment with a start nozzle assembly 26 which is forms a parallel fluid path to that through the drilling nozzle assembly. The start nozzle assembly 26 is accordingly serially coupled in fluid communication with the accumulator 22 through an on/off valve 27.

To establish the initial pressure $P_o$, the drilling nozzle assembly 10 is initially isolated from the flow line by the closure of valve 24. With valve 27 opened, the flow from the high pressure source 14 through the ramping orifice 20, accumulator 22 and the jet-forming orifice of the start nozzle 26 establishes the starting pressure $P_o$ at the jet-forming orifice in the drilling nozzle assembly 10 downstream from the accumulator. A diameter of 0.006 inches for the jet-forming orifice $d_s$ of the start nozzle assembly has been generally found to be satisfactory. Once the initial pressure has been established, the start nozzle assembly is isolated from the pressure line by the closure of valve 27, and the drilling nozzle assembly is coupled to the pressure line by the opening of valve 24.

The isolation of the start nozzle assembly, and the re-direction of the fluid through the drilling nozzle assembly, causes the pressure at the jet-forming orifice in the drilling nozzle assembly 10 to ramp upward because the diameter of start nozzle orifice $d_s$ is greater than that of the drilling orifice $d_d$. The rate of pressure increase is a function of $d_d$, $d_u$ and the volume (V) of the accumulator 22 for a given value of pressure at the source 14. The final steady state pressure at the drilling orifice is a function of $d_d$ and $d_u$. After the drilling operation has been completed, valve 24 can be closed, and valve 27 thereafter opened to re-establish the starting pressure $P_o$ downstream from the accumulator.

In the event that a rapid discharge of pressure is desired at the completion of the drilling operation, a dump nozzle assembly 28 may be used. The dump nozzle is serially coupled in fluid communication to the downstream end of the accumulator via an on/off valve 30. The jet-forming orifice of the dump nozzle assembly has a relatively large diameter ($d_e$) of 0.009 inches. Accordingly, the opening of the normally closed valve 30 results in a rapid discharge of the pressure downstream from the accumulator. Although the start nozzle assembly 26 might be used for this purpose, the longer discharge period resulting from its relatively smaller orifice size may be unsatisfactory in some applications where a dwelling of the jet has a significant effect on the size and shape of the hole.

The bypass valve 25 is an on/off valve which is normally closed if the ramping orifice 20 is in operation. To bypass the ramping orifice, the bypass valve is opened to cause an immediate rise in the pressure downstream from the accumulator to that of the source 14.

Figure 6:
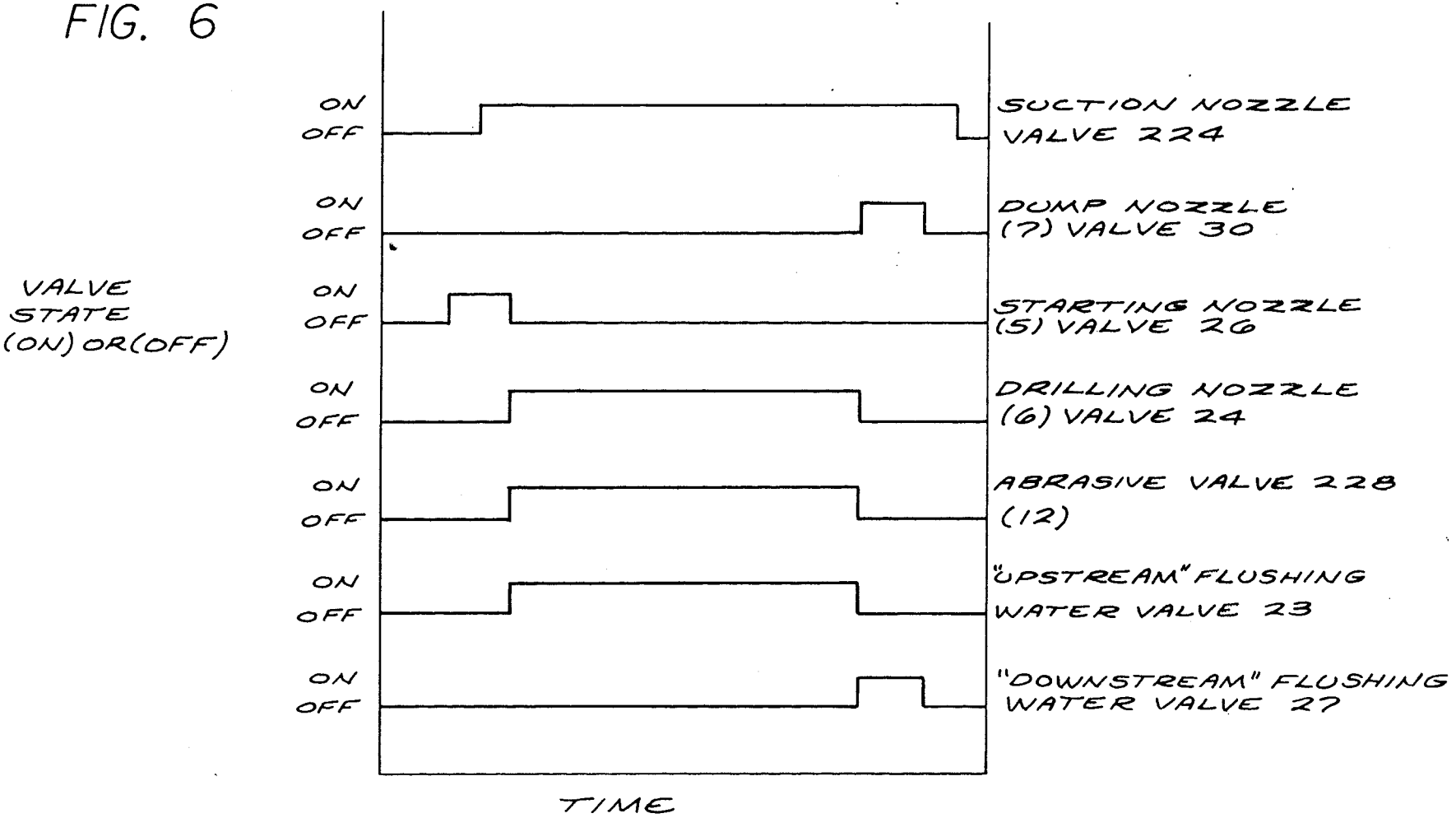
FIG. 6 is a schematic illustration of the state of the valves illustrated in FIG. 1 during various periods in the operating cycle of the system of FIG. 1.

FIG. 6 graphically illustrates the preferred timing of the opening and closing of the various valves in FIG. 4. The start nozzle is first activated by the opening of valve 27 to establish the start pressure downstream of the accumulator 22. The suction nozzle is then activated by opening the valve 224. Just prior to activation of the drilling nozzle by the opening of valve 24, the abrasive feed valve 228 is opened to establish a flow of abrasive through the drilling nozzle 10 to the suction nozzle 212.

The drilling nozzle is then activated by the opening of valve 24, and the start nozzle is deactivated by the closing of valve 27. It may be noted, however, that the abrasive feed need not be commenced prior to activation of the drilling nozzle because the relatively low start pressure will not cause fracture or delamination of the workpiece if impacted upon by an abrasive-free waterjet.

To prevent abrasive residue from accumulating within the nozzle assembly, low pressure flushing liquid is introduced into the abrasive path both upstream and downstream of the mixing region. The accumulation of abrasive can adversely effect the drilling operation in two ways. First, the accumulation can impede the flow of abrasive, decreasing the drilling efficiency of the nozzle assembly. Secondly, masses of accumulated abrasive which form upstream of the mixing region can suddenly become entrained into the jet, risking imprecise drilling and damage to the workpiece.

Accordingly, low pressure flushing liquid is introduced into the drilling nozzle assembly 10 from a low pressure source 11 of tap water or the like. Referring momentarily to FIG. 5, the flushing liquid is introduced into the abrasive path both upstream and downstream of the mixing region via an upstream flushing passageway 48 and a downstream flushing passageway 59, respectively. Since the downstream flushing fluid of passageway 59 does not interfere with the entraining process in the mixing region, the flushing liquid can be introduced into the nozzle assembly throughout the drilling operation if desired, or just after each drilling operation. The upstream flushing fluid, on the other hand, is introduced only after completion of a drilling operation in order to avoid interference with formation of the abrasive-laden jet.

Returning to FIG. 6, the drilling operation is completed by the closing of the drilling nozzle valve 24, the abrasive feed valve 228 and the vacuum nozzle valve 224 just after the opening of the dump nozzle valve 30. The upstream flushing liquid is then introduced by opening valve 29 to prevent any accumulated abrasive from harmfully impacting the workpiece during the next drilling operation.

It will be understood that one may alternatively implement the time-varying pressure profiles by means of a microprocessor-controlled high pressure pump whose output is varied in accordance with programmed instructions correlating the process parameters to the types and dimensions of the materials to be cut.

In accordance with another aspect of the invention, the size of the drilled hole is controlled by controlling the dwell time of the jet after it drills through the material. The full penetration by the jet creates a change in the sound level generated by the drilling operation, with a substantial increase in the sound level occurring after full penetration of the jet through the workpiece. Accordingly, a microphone 17 is positioned to detect the sound level generated by the drilling operation, and is coupled to a timing circuit which deactivates the drilling jet at a preselected time after the sound level change.

When holes are to be drilled in a pressure-sensitive material at a non-perpendicular angle to its surface, the obliquely impacting jet is sometimes deflected by the workpiece's surface in a manner which damages the portion of the workpiece adjacent the hole. This is particularly true when the workpiece is a composite-sprayed metal, wherein the jet can ricochet off the substrate and crack the composite coating.

Accordingly, it is preferable when drilling oblique holes under such circumstances, to commence the drilling operation with the jet axis 90° to the material's surface. Once the jet has penetrated the top surface of the pressure sensitive material, its angle of incidence is changed progressively until the appropriate orientation is achieved. Although the optimal rate of angular change will vary with the material and its thickness, a rate of approximately 10°/sec. has been found to be generally satisfactory. When drilling through a ⅛-inch ceramic coating, for example, the pivoting may commence approximately 1–2 seconds after initial impact.

While the foregoing description includes detail which will enable those skilled in the art to practice the invention, it should be recognized that the description is illustrative in nature and that many modifications and variations will be apparent to those skilled in the art having the benefit of these teachings. It is accordingly intended that the invention herein be defined solely by the claims appended hereto and that the claims be interpreted as broadly as permitted in light of the prior art.

I claim:

1. A method for drilling a small diameter hole in a workpiece having at least one layer of material which tends to crack when impacted upon by a coherent high velocity jet of liquid, said material having front and back surfaces, the method comprising the steps of:

coupling a source of high pressure liquid to a jet-forming orifice of a nozzle assembly to form a coherent, high velocity drilling jet;

discharging the jet at the workpiece; and varying the pressure at at least one rate during at least a substantial portion of the drilling operation through the material.

2. The method of claim 1 wherein the pressure-varying step includes the steps of establishing a first relatively low pressure at which the jet initially impacts on the crackable material, and generally ramping the pressure upwards towards a maximum pressure as the jet drills through the crackable material.

3. The method of claim 2 further including the step of ramping the pressure generally downward towards said relatively low pressure as the jet closely approaches the back surface of the crackable material from within the interior thereof so that the jet emerges from the back surface with the liquid subjected to a pressure which is lower than that applied in the region approximately midway through the brittle material.

4. The method of claim 2 including the step of establishing the low pressure by coupling a supplemental orifice to the pressurized liquid source in parallel with the jet-forming orifice of a waterjet nozzle assembly, and directing the pressurized liquid through the supplemental orifice to establish the relatively low pressure.

5. The method of claim 4 wherein the supplemental orifice is substantially isolated from the pressurized fluid after the low pressure is established, and the jet-forming orifice of the nozzle assembly is substantially simultaneously coupled to the fluid at the relatively low initial pressure.

6. The method of claim 4 including the step of deactivating the supplemental orifice while the jet is formed by the liquid at a time-varying pressure.

7. The method of claim 2 wherein the ramping of the pressure includes the step of placing accumulator means in serial fluid communication with the supplemental orifice and the jet-forming orifice so that pressurization of the liquid within the accumulator causes corresponding downstream pressurization of the liquid at the jet forming orifice.

8. The method of claim 7 including means in fluid communication with the accumulator means and in parallel with the jet-forming orifice for venting the pressurized liquid within the accumulator to reduce the pressure of the liquid downstream at the jet-forming orifice.

9. The method of claim 1 wherein the step of varying the pressure includes the step of directing the liquid from said source. to an upstream orifice of an accumulator means in serial fluid communication with the source of pressurized fluid and the jet-forming orifice of the nozzle assembly so that pressurization of the liquid within the accumulator means causes corresponding downstream pressurization of the liquid at the jet-forming orifice.

10. The method of claim 9 including the step of bypassing the upstream orifice to substantially terminate the time-varying profile of the pressure.

11. The method of claim 1 including the additional step of monitoring the workpiece-impacting jet to determine the completion of the jet penetration through the workpiece.

12. The method of claim 11 including the step of stopping the formation of the jet in response to an increase in the noise level.

13. The method of claim 8 including the step of stopping the formation of the jet for a predetermined period of time after an increase in the noise level.

14. The method of claim 1 including the steps of entraining abrasive material into the jet within the mixing region of a nozzle assembly prior to discharge so that the workpiece is drilled by a resulting laden jet, and flushing at least a portion of the abrasive path within the nozzle assembly with low pressure liquid in between drilling operations to remove any accumulated abrasive material.

15. The method of claim 14 including the step of flushing the abrasive path upstream of the mixing region during the drilling operation.

16. The method of claim 14 including the step of flushing the abrasive path downstream of the mixing region.

17. The method of claim 14 including the step of drawing abrasive at a flow rate through the mixing region of the nozzle assembly with a partial vacuum source.,so that the flow rate of the abrasive is substantially independent of the pressure of the liquid forming the high velocity jet.

18. A method for drilling a small diameter hole in a multilayer workpiece having at least one layer of pressure-sensitive material which tends to crack when impacted upon by a coherent high velocity jet of liquid, said material having a front surface initially impacted by the jet, and a back surface disposed on a substrate of non-pressure-sensitive material, the method comprising the steps of:

forming a coherent, high velocity drilling jet from a liquid which is at a first relatively low pressure;

directing the jet at the front surface of the pressure-directing material on the workpiece;

generally ramping the pressure of the liquid upward at a first rate as the jet penetrates the layer of pressure-sensitive material; and generally ramping the jet towards a final operating pressure at a second rate greater than the first rate as the jet encounters the substrate.

19. The method of claim 18 including the steps of the entraining abrasive material into the jet within the mixing region of a nozzle assembly prior to discharging so that the workpiece is drilled by a resulting abrasive-laden jet, and gradually increasing the abrasive flow fate with a partial vacuum source as the pressure of the liquid generally increases.

20. A method for drilling a small diameter hole in a multilayer workpiece having at least one layer of fragile material disposed on at least one layer of non-fragile material, the fragile material being of the type which tends to crack when impacted upon by a coherent high velocity jet of liquid, the non-fragile material being impacted upon by the drilling jet prior to the fragile material, and the impacted fragile material forming an external surface of the workpiece, the method comprising the steps of:

drilling through the non-fragile material by impacting the workpiece with a coherent, high velocity liquid jet formed from a liquid at a relatively high pressure;

generally ramping the pressure of the liquid downward as the drilling jet approaches the external fragile surface of the workpiece; and drilling through the fragile exterior surface with the jet being formed from the liquid at a substantially reduced pressure.

21. The method of claim 20 including the steps of entraining abrasive material into the jet within the mixing region of a nozzle assembly prior to discharge so that the workpiece is drilled by a resulting abrasive-laden jet, and gradually decreasing the abrasive flow rate with a partial vacuum source as the pressure of the liquid generally decreases.

22. A method for drilling a small diameter axially-extending hole in a workpiece having at least one layer of material which tends to crack when impacted upon by a coherent high velocity jet of liquid, the axis of the hole intersecting the surface of the material at an acute angle, the method comprising the steps of:

coupling a source of pressurized liquid to a jet-forming orifice of a nozzle assembly to form a coherent, high velocity drilling jet;

directing the jet at the workpiece so that the jet impacts substantially perpendicularly on the workpiece surface at said intersection;

permitting the jet to penetrate the surface of the workpiece varying the pressure at at least one rate during at least a substantial portion of the drilling operation through the material;

pivoting the relative position of the jet and workpiece so that the jet strikes the intersection at an increasingly non-perpendicular angle until the jet is coaxial with the axis of the required hole.

23. A method for drilling a small diameter hole in a workpiece having at least one layer of material which tends to crack when impacted upon by a coherent high velocity jet of liquid, said material having front and back surfaces, the method comprising the steps of:

coupling a source of pressurized liquid to a jet-forming orifice of a nozzle assembly to form a coherent, high velocity drilling jet;

directing the jet at the workpiece varying the pressure at at least one rate during at least a substantial portion of the drilling operation through the material; and directing the jet through the hole for a predetermined time after complete penetration of the material to vary the dimension of the hole.

* * * * *